US005941741A

United States Patent [19]

Dobbelaere et al.

[11] Patent Number: 5,941,741

[45] Date of Patent: Aug. 24, 1999

[54] ONE-PIECE CONTACT SPRING

[75] Inventors: Joris Dobbelaere, Beernem, Belgium; Hans-Jost Heimueller, Dudenhofen, Germany; Dimitri Meulemeester, Torhout, Belgium

[73] Assignee: Siemens Aktiengesellschaft, Munich, Germany

[21] Appl. No.: 09/023,721

[22] Filed: Feb. 13, 1998

[30] Foreign Application Priority Data

Feb. 13, 1997 [DE] Germany ..... 197 05 509

[51] Int. Cl.[6] ..... H01R 11/22

[52] U.S. Cl. ..... 439/852; 439/862

[58] Field of Search ..... 439/851, 852, 439/862

[56] References Cited

U.S. PATENT DOCUMENTS

| | | | |
|---|---|---|---|
| 4,152,042 | 5/1979 | Ostapovitch . | |
| 4,530,562 | 7/1985 | Reynolds | 439/851 |
| 4,560,231 | 12/1985 | Shirai | 439/851 |
| 4,564,259 | 1/1986 | Vandame | 439/852 |
| 4,834,681 | 5/1989 | Chaillot | 439/852 |
| 5,575,696 | 11/1996 | Endo | 439/852 |
| 5,643,018 | 7/1997 | Sakai | 439/852 |
| 5,681,190 | 10/1997 | Childs | 439/852 |
| 5,685,746 | 11/1997 | Maejima | 439/852 |

FOREIGN PATENT DOCUMENTS

| | | |
|---|---|---|
| 2157490 | 6/1976 | France . |
| 2249705 | 4/1973 | Germany . |

*Primary Examiner*—Steven L. Stephan
*Assistant Examiner*—Javaid Nasri
*Attorney, Agent, or Firm*—Herbert L. Lerner; Laurence A. Greenberg

[57] ABSTRACT

The one-piece contact spring has two spring arms, bent back inwardly in a box-shaped contact part. The spring arms are supported on a support which helps relieve the bend. The support is recessed into the box interior from the forward end of the bend by approximately two to five times the thickness of the bottom or top wall, respectively. A preferred embodiment of the one-piece contact spring has spring arms supported by support arms stamped and bent out from the bottom wall and the top wall.

14 Claims, 5 Drawing Sheets

11
13
15
17
19
21
23
25
27
41
49

ONE-PIECE CONTACT SPRING

BACKGROUND OF THE INVENTION

FIELD OF THE INVENTION

The invention relates to a one-piece contact spring having a box-shaped contact part, onto which a bottom wall and a top wall are formed, from each of which a spring arm is bent backward on the insertion end into the interior of the contact part, wherein the spring arms extend toward one another and are provided on their ends with freely resilient rounded contact points, and having a connection part, formed onto it opposite the insertion end.

Contact springs are widely used as plug connector, in automotive engineering, for instance, and often have two parts that have to be made separately from one another, namely a bottom spring and a top spring, or locking sleeve, that has to be folded over onto the bottom spring. On its end toward the insertion end of the contact spring, the bottom spring has two spring arms, onto whose end remote from the insertion end of the contact spring a connection part for an electrical conductor is formed integrally. The bottom spring is preferably a stamped and bent part and because of the requisite good electrical property it preferably comprises tin-plated brass, tin-plated copper, or so-called spring bronze. The top spring that is to be folded over onto the bottom spring has the function essentially of increasing the spring force of the contact spring, and by embodying it with one or more detent tongues of enabling a releasable locking of the contact spring in a contact chamber of a housing made of insulating material. The releasable locking of the contact spring by such detent tongues is also called primary locking. As a rule, the top spring comprises a material with good spring properties and can likewise be made as a stamped and bent part. Sheet metal, for instance, is a suitable material.

Contact springs having two elements that have to be made separately from one another, namely the grand the top spring, have the disadvantage that relatively major effort must be expended to secure the top spring on the bottom spring in a slip-proof manner. Moreover, the known contact springs having bottom springs and top springs fitted over them are relatively expensive in terms of both materials and the effort of assembly.

Less expensive, one-piece contact springs have also been disclosed, however. One such one-piece contact spring is shown for instance in the two references, U.S. Pat. No. 4,152,042 and French patent disclosure FR A 2 157 490. In both references, box-shaped contact parts of a contact spring are described that have spring arms bent backward into the box interior.

FR-A 2 157 490 describes a box-shaped contact part of a contact spring that either has spring arms bent back from each of the four side walls, or only two spring arms bend back opposite one another. In the exemplary embodiment described there that has the four spring arms bent back into the box interior, these arms rest flatly on the associated side wall over a relatively long region and are then bent obliquely inward over the remainder of the length. In the exemplary embodiment described there having only two spring arms bent back into the box interior, the spring arms are approximately V-shaped, and they rest with their ends on the associated inner walls of the side walls again. The opposed spring arms are spaced relatively far apart from one another. Because of the relatively wide spacing of the spring arms from one another, a satisfactory connection with an introduced plug contact is possible, with these contact springs, only if the plug contact has an adequate thickness or width. If a too-small plug contact is introduced into this contact spring, then only a very poor contact or none at all is possible.

In U.S. Pat. No. 4,152,042, a contact spring is described which is improved by comparison. The contact spring is distinguished by two spring arms bent back into the box interior from two opposed side walls. The spring arms are bent backward 180 from the attached side walls and then extend toward one another in curved fashion. The free ends of these spring arms are provided with rounded contact points facing one another at a relatively close distance, which enable a secure plug connection even if a small pug contact is plugged in. To relive the bend of the two spring arms, the spring arms are provided with a recess on the inside, in the region of the bend. As a result, greater elasticity of the bend is attained. However, beginning at the bend, the spring arms extend toward one another in curved fashion. This necessarily means that the bend is stressed relatively severely when a plug contact is introduced into the contact spring and the ends of the spring arms are thus forced apart. The result, under some circumstances, can be damage or breakage of the contact spring at the bent points.

SUMMARY OF THE INVENTION

It is accordingly an object of the invention to provide a one-piece contact spring, which overcomes the above-mentioned disadvantages of the heretofore-known devices and methods of this general type and which has greater strength and thus suffers no damage even when a corresponding plug contact is plugged in repeatedly.

With the foregoing and other objects in view there is provided, in accordance with the invention, a one-piece contact spring, comprising:

a box-shaped contact part having a bottom wall with a given thickness and a top wall, and the box-shaped contact part having an insertion end and an interior;

spring arms respectively formed on the bottom wall and the top wall, the spring arms being bent backward about a bend at the insertion end of the contact part and extending into the interior thereof, the spring arms having free ends with rounded contact points and approaching one another from the insertion end towards the free ends in the interior;

a connection part formed onto the box-shaped contact part opposite the insertion end;

respective supports supporting each of the spring arms for relieving the bend of the spring arms, the supports being offset from the bend and towards the interior of the contact part by a spacing distance amounting to substantially two to five times the given thickness of the bottom wall.

In other words, the novel spring contact is distinguished in that each of the two spring arms is supported on a support for relieving the bend of the respective spring arm, and in that the support is disposed inward into the box, from the front end, by a distance which is approximately two to five times the thickness of the bottom wall and the top wall.

By embodying the contact spring in this way, a very economical, reliable, robust miniature bush contact suitable for so-called mat seals can be made, for instance for a plug contact 0.63 mm by 0.63 mm in size, with a crimped or IDS line connection. Such a contact spring can easily be positionally secured inside a plug housing by means of a detent hook suitable for the purpose.

By means of the support device of the invention, which is to be disposed at a very specifically predetermined location in the contact spring on the bottom or top wall so as to relieve the spring arms integrally formed on there, effective breakable protection at the bending points can be achieved even when a plug contact is inserted repeatedly.

The fact that the support is moved inside the box by about two to five times the wall thickness makes it possible to attain an optimal relief of the bending point of the spring arm.

In accordance with an added feature of the invention, the supports are defined by a kink in each of the spring arms, and each of the spring arms is supported at its kink against the bottom wall or the top wall, respectively. The kink support thus aids the strength of the contact arms, which are otherwise weakened by the 180° bend.

In accordance with an additional feature of the invention, the bottom wall and the top wall have a recess formed therein each defining a respective support for the spring arms. In the alternative, the support may be defined by a nipple formed on each of the bottom wall and the top wall.

In accordance with a further feature of the invention, each of the spring arms is thinned at the bend, forming an opening at the bend extending substantially transversely to the spring arm.

In accordance with again an added feature of the invention, a first support arm is stamped out of the bottom well and a second support arm is stamped out of the top wall. The support arms are bent towards the spring arms and they support the spring arms approximately centrally between the bend and the free end thereof. The support arms are particularly suitable where more stringent demands of the contact force are made, such as for tin-plated contacts.

In accordance with again an additional feature of the invention, each of the first and second support arms has a chamfered free end. The chamfer on the distal ends of the support arms increases the bearing surface area between the support arms and the spring arms. In order on the one hand not to increase the structural length of the box-shaped contact part unnecessarily and on the other to attain the greatest possible elastic deflection of the springy arms, the force reinforcement is effected by the support arms not at the contact location itself—that is, in the region of the rounded contact points of the spring arms—but rather approximately in the middle of the spring arms.

In accordance with again another feature of the invention, a reinforcing bead is formed at the first support arm and at the second support arm.

In accordance with again a further feature of the invention, the spring arms have a length B+C from the support to the rounded contact point, and a ratio B:C is approximately between 2:3 and 3:2; the first and second support arms have a length D approximately 0.8 to 1.2 times B; and the first and second support arms contact the respective spring arm at a boundary between B and C.

The spring arms with the above-noted dimensions are preferably formed such that, under heavy stress, they strike against the inner walls of the bottom wall and the top wall and are thus protected against being bent too far.

In accordance with yet an added feature of the invention, the box-shaped contact part has a given width defined by a width of the top wall, and there is provided a box tab extending over an outer surface of the top wall across approximately half its width.

In accordance with yet another feature of the invention, a protrusion is formed on the top wall, and a side wall of the contact part has a recess formed therein on which the protrusion is flatly supported.

In accordance with yet an additional feature of the invention, the contact part has two side walls extending between the bottom wall and the top wall, at least one of the side walls has a slot or an impression formed therein pointing into the interior, the slot or impression serves as a stop during a bending operation when a sheet-metal part is formed into the contact spring.

In accordance with a concomitant feature of the invention, the spring arms have an overlay of gold or a tin layer at the rounded contact points.

Other features which are considered as characteristic for the invention are set forth in the appended claims.

Although the invention is illustrated and described herein as embodied in a one-piece contact spring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figures 1A, 1B, 1C, 1D, 1E:
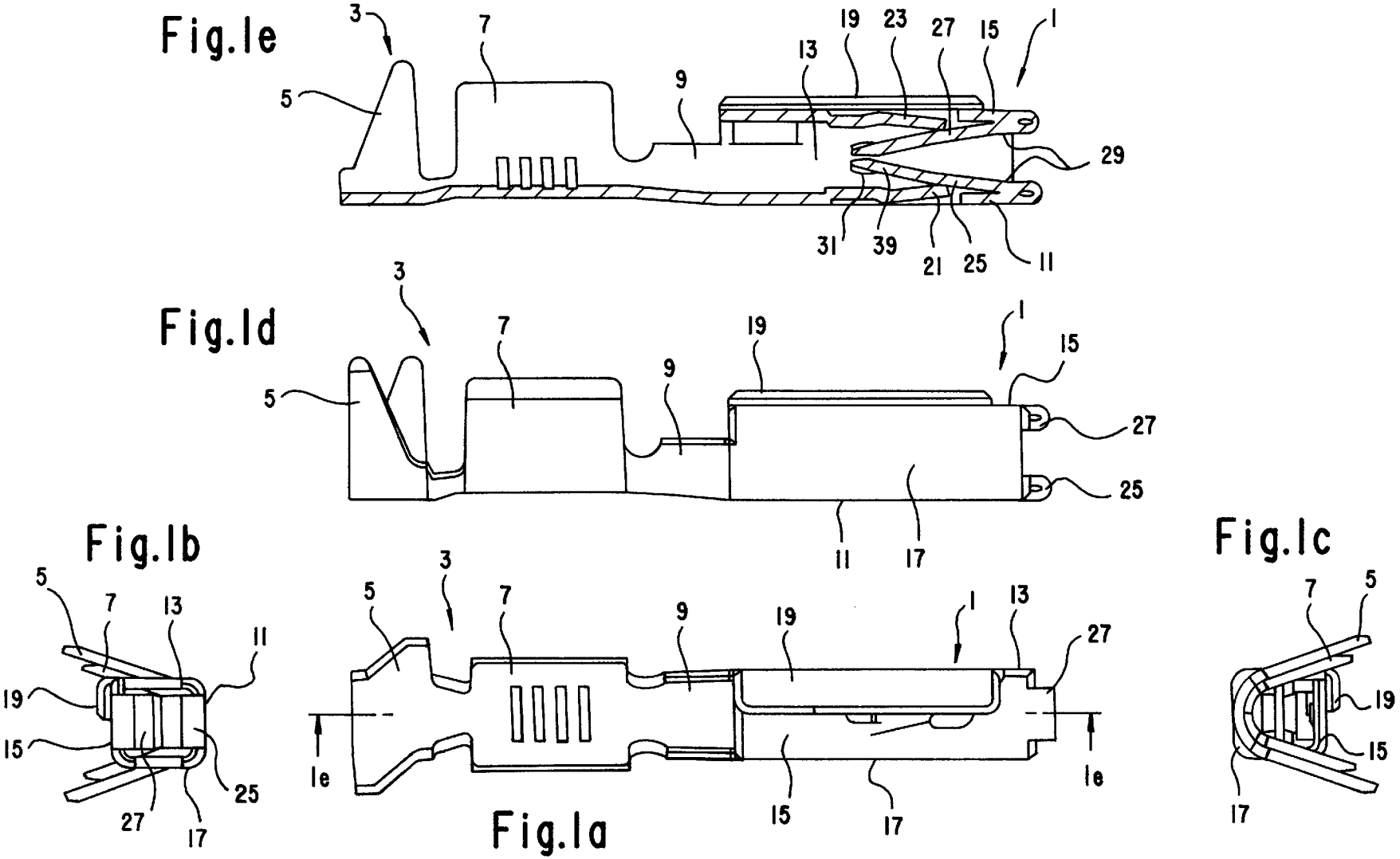
FIG. 1*a* is a top plan view on a first embodiment of a contact spring according to the invention.
FIG. 1*b* is a rear elevational view thereof.
FIG. 1*c* is a front elevational view thereof.
FIG. 1*d* a side elevational view of the contact spring.
FIG. 1*e* is a longitudinal sectional view thereof taken along the line A—A in FIG. 1*a*.

Referring now in detail to the figures of the drawing, wherein identical parts are identically identified throughout, and first, particularly, to FIG. 1 thereof, there is seen a first exemplary embodiment of a one-piece contact spring of the invention, in various views. FIG. 1*a* shows the one-piece contact spring with a view from above onto the interior of the connection part 3, which here by way of example is U-shaped and which is joined to a box-shaped contact part via a U-shaped connecting strut. The entire contact spring is formed from a stamped sheet-metal part, which is bent in a special way as described in conjunction with FIG. 5.

FIGS. 1*b* and 1*c* show the plan views onto the contact spring from behind and from the front, respectively. FIG. 1*d* is a side view and FIG. 1*e* a sectional view taken along the line A—A of FIG. 1*a* through the contact spring.

In the exemplary embodiment shown, the connection part is embodied as a crimped connection. However, some other connection part may be provided here, such as what is known as an IDC connection. In the exemplary embodiment shown, the crimped connection has a rear insulation claw 5 and a conductor wire claw 7 adjoining it in the insertion direction. The conductor wire claw 7 is formed onto the box-shaped contact part 1 via the aforementioned connecting strut 9.

The box-shaped contact part has a bottom wall 11 and a top wall 15, which are joined to one another by a first side wall 17. A second side wall 13 adjoins the bottom wall 11 parallel to the side wall 17. The side wall 13, on its upper end, has a box tab 19 protruding orthogonally towards the opposite side wall 17. The box tab 19 fits over the top wall 15 and thus serves the purpose of securely clamping the box-shaped contact part 1.

Figure 2:
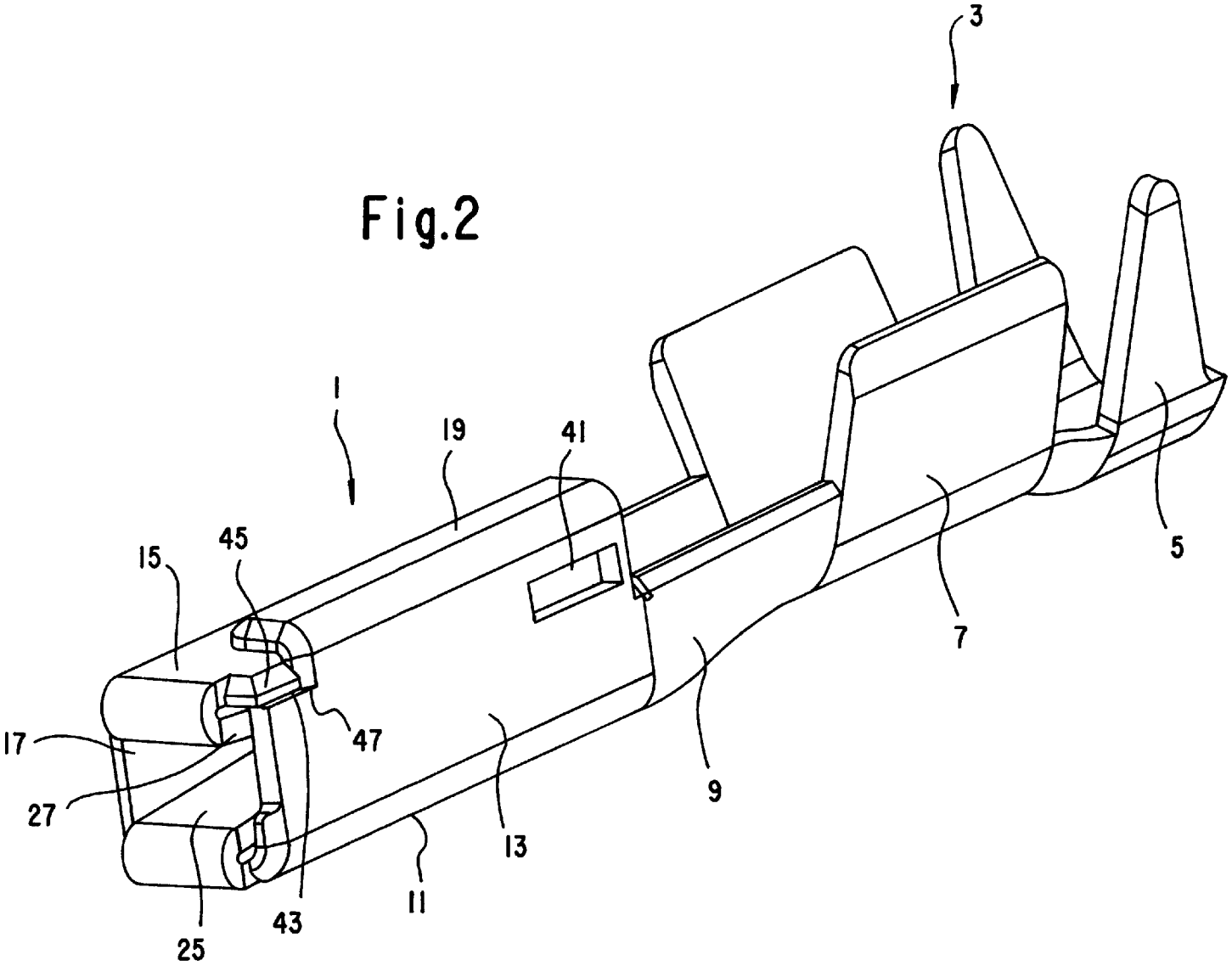
FIG. 2 is a top perspective view of the contact spring.

As the various views of FIG. 1 and in particular the perspective view of the contact spring of FIG. 2 show, the box tab 19 does not extend quite all the way to the front end of the box-shaped contact part 1. In other words, the box tab 19 is shorter than a width of the box formed by the contact part 1. As the perspective view of FIG. 2 shows especially clearly, the side wall 13 in its front region has an L-shaped, rearward-extending recess 47, in which a protruson 45 formed onto the top wall 15 rests flatly. Thus the recess 47 acts as a stop for the protrusion 45. The stop is identified by reference numeral 43 in FIG. 2.

The box tab 19, which extends only about halfway across the top wall 15, serves not only to clamp the box-shaped contact part 1 securely but can at the same time act as a polarizing means. If a housing into which the contact spring is to be inserted has a corresponding inner wall, then it is assured that the contact spring can never be plugged in by the wrong end.

The perspective view of FIG. 2 additionally shows a slot 41, which is machined into the side wall 13. The slot 41 may instead be an impression. The slot 41 serves as a stop for a bending process, which will be described below in conjunction with FIG. 5.

With reference to the sectional view of FIG. 1*e*, the one-piece contact spring has two spring arms 25, 27, which are formed integrally onto the bottom wall 11 and the top wall 15, respectively. The spring arms 25, 27 are bent back into the box interior by an angle of 180°. The two spring arms 25, 27 extend toward one another with their distal ends and on their ends are provided with freely resilient rounded contact points 31. The two rounded contact points 31 are relatively close together, so that even when small contact pins are inserted, secure and reliable contacting is assured. In the exemplary embodiment shown in FIG. 1*e*, the distal ends of the two spring arms 25, 27 extend backward approximately halfway into the interior of the contact part 1. At least in the region of the rounded contact points, the two spring arms 25, 27 are preferably provided with a metallizing layer, such as a gold or tin overlay 39, thereby enabling even better contacting of an inserted contact pin.

To relieve the 180° bend, the two spring arms 25, 27 are supported on a support device 29, which will be described in greater detail in the following with reference to FIGS. 3 and 4.

Furthermore, support arms 21 and 23 are machined into the bottom wall 11 and the top wall 15, respectively. The support arms 21, 23 are bent into the interior of the box and support the spring arms 25, 27 approximately in the middle, i.e., at a location which is spaced well apart from the region of the rounded contact point. To assure that the spring arms 25, 27 rest properly on the support arms 21, 23, the support arms 21, 23 are chamfered on their forward end (see dashed line in FIGS. 3, 4).

The support arms 21, 23 serve to limit the bending strain. Since the support arms 21, 23 are intrinsically resilient, a substantially longer spring travel for the same contact force is assured.

Figure 3:
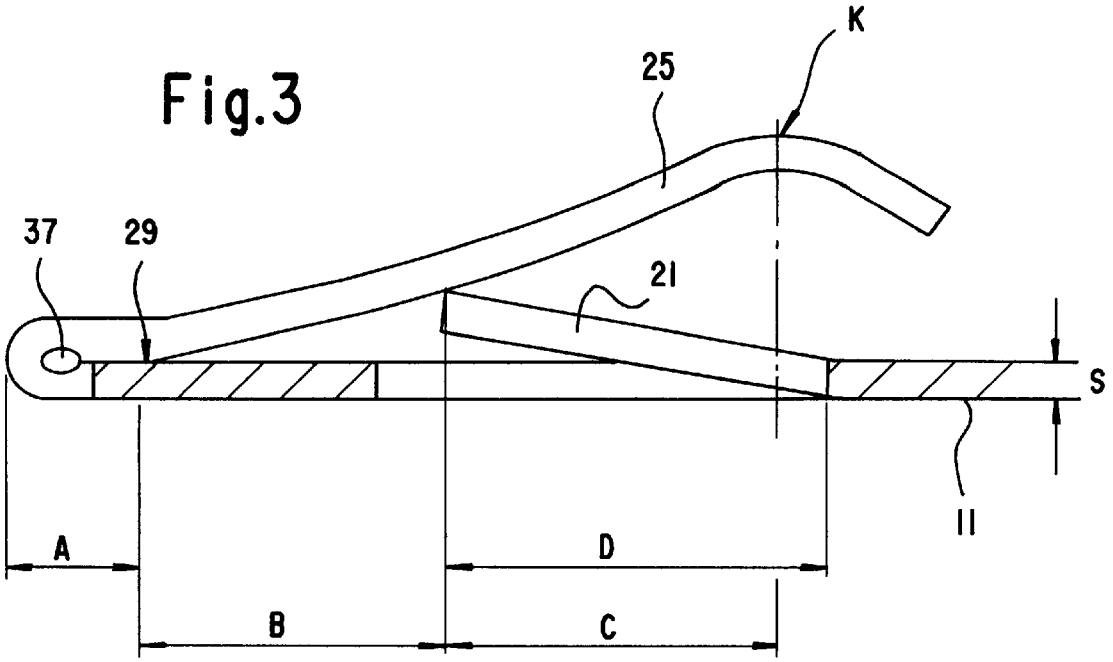
FIG. 3 is a sectional view of a detail of a spring arm, with a kink of the spring arm acting as a support device.
Figure 4:
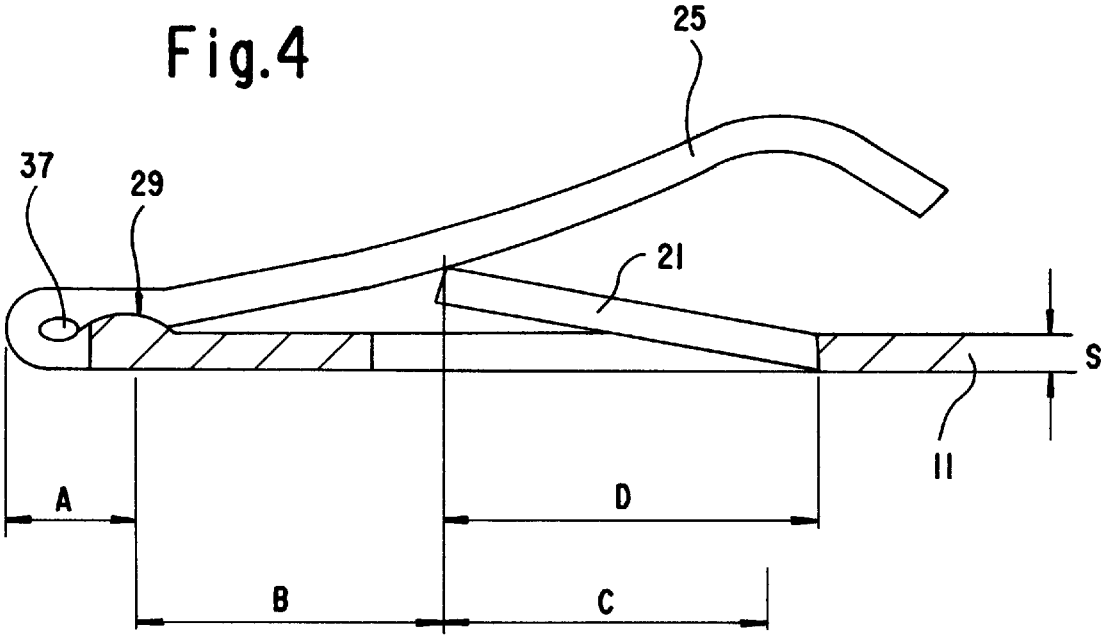
FIG. 4 is a similar view, illustrating a recess formed in the bottom wall acting as the support device.

Referring now to FIG. 3, the above-mentioned support device 29 and the dimensioning of the spring arms 25, 27 and support arms 21, 23 is illustrated in the detail of the front end of the contact part 1. Only the bottom wall 11, support arm 21 and spring arm 25 are shown in the fragmentary view of FIG. 3. The dimensioning of the support arm 23 and the associated spring arm 27 is similar.

Assume the bottom wall 11 has a thickness S. The support device 29 is offset rearward by the distance A from the front end of the 180° bend. The spring arm 25 has a kink at that point. From the bend to the kink the spring arm 25 rests approximately flatly on the bottom wall 11. From that point, the spring arm 25 rises obliquely upward over a length B+C, up to its contact point K. From the contact point K, the spring arm 25 extends backward some distance toward the bottom wall 11. The support arm 21 has a length D and supports the spring arm 25 at the connecting point of B+C. In accordance with the invention, the aforementioned lengths A, B, C and D are dimensioned within the following ranges:

A=2×S to 5×S (A is between two times S and five times S);

B/C=2/3 to 3/2;

D=0.8×B to 1.2×B.

For further relief of the 180° bend and to increase the elasticity of the spring arm 25, a recess 37 may be provided at the 180° bend, the recess being formed by a grooved thinning of the sheet-metal part at that point.

Instead of the support device 29 formed by a kink, as shown in FIG. 3, it is also possible to press a nipple or a domelike bulge into the bottom wall 11 and to support the spring arm 25 thereon. This example is shown schematically in FIG. 4. The above dimensions apply in that embodiment as well.

Figure 6:
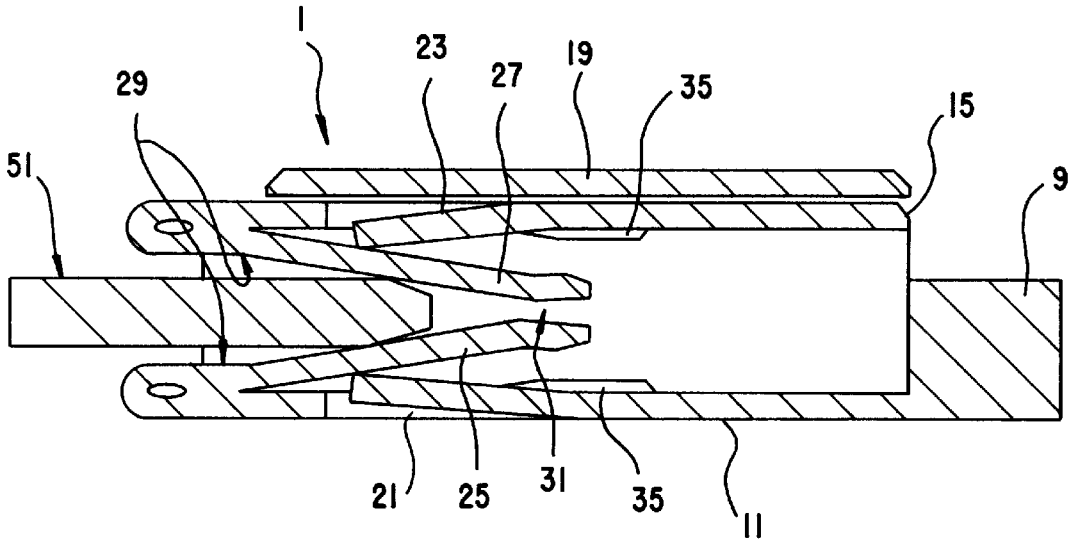
FIG. 6 is a partial sectional view taken through the contact part of the contact spring of FIGS. 1–3, with a contact pin inserted.

In the view of FIG. 6, the box-shaped contact part 1 is shown with a contact pin 51 not yet thrust all the way in between the contact springs 25, 27. The bottom wall 11 and the top wall 15, to relieve the support arms 21, 23, each have a reinforcing bead 35 as well. Once the contact pin 51 has been thrust all the way in, the spring arms 25, 27 can support themselves by their distal ends on these reinforcing beads 35 and are thus protected against being bent too far.

Figure 7:
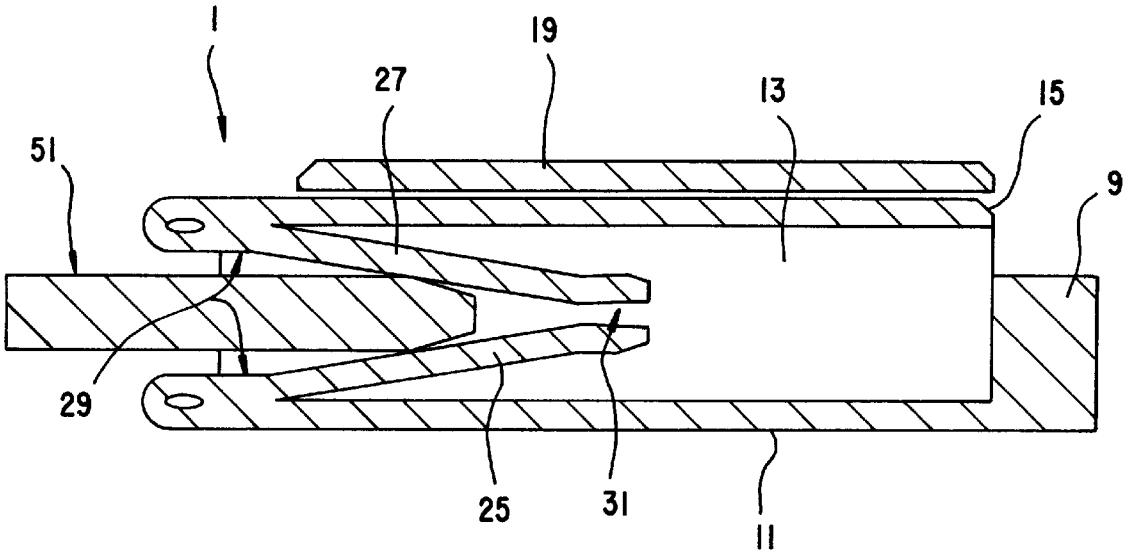
FIG. 7 is a similar view to FIG. 6, illustrating an embodiment without support arms supporting the spring arms.

As FIG. 7 shows, it is also within the scope of the invention to embody the described one-piece contact spring without the aforementioned support arms. What is essential, however, is the embodiment of the support 29, in the form of the kink or the aforementioned nipple, in the region indicated.

Referring now to FIG. 5, the one-piece contact spring is bent in various steps from a one-piece metal part.

Figures 5A, 5B, 5C, 5D, 5E, 5F, 5G, 5H:
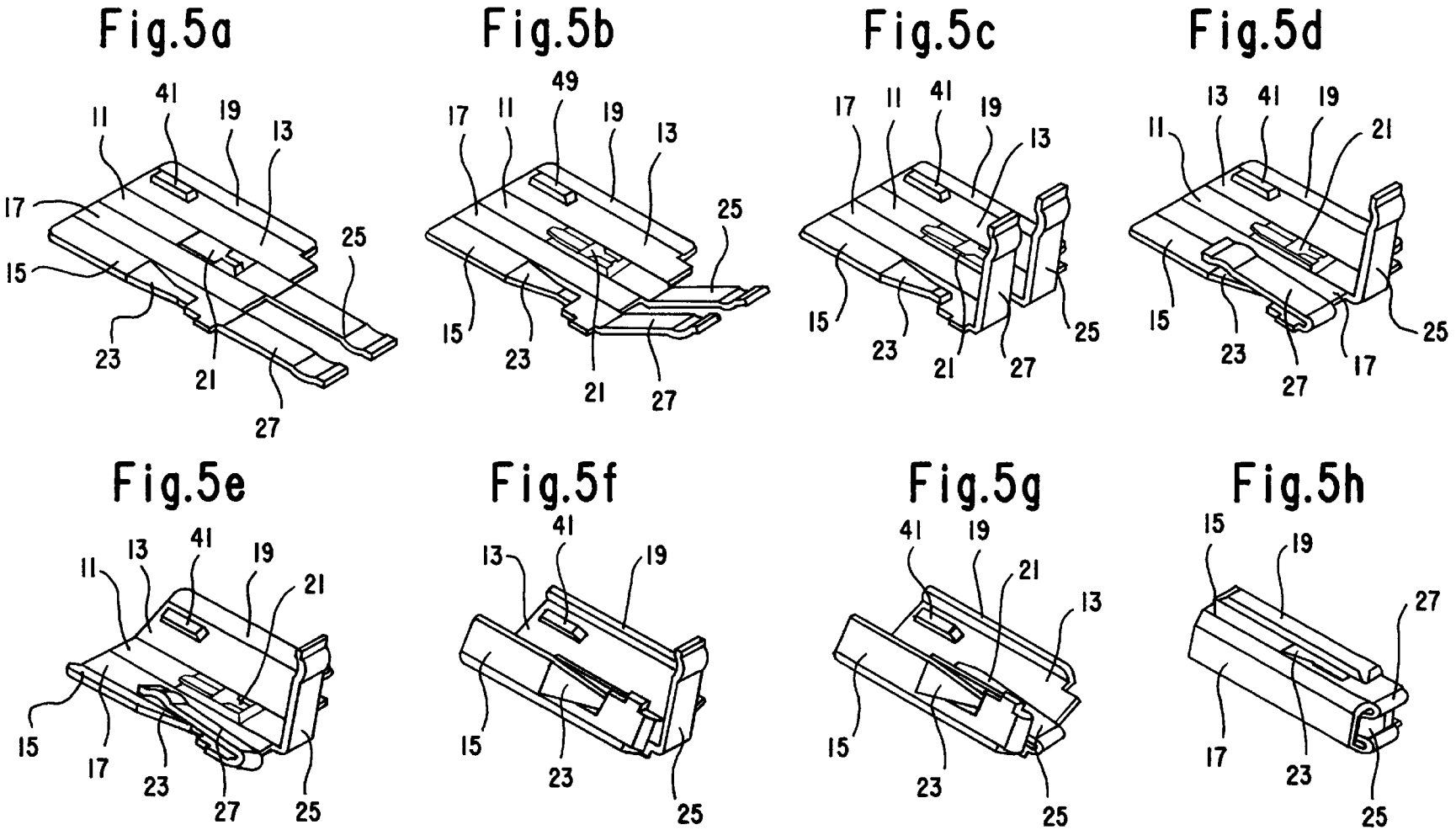
FIGS. 5*a*–5*h* are perspective views illustrating various steps in a bending operation for forming the contact spring of FIGS. 1–3 from a stamped-out sheet-metal part.

FIG. 5*a* shows an already fully stamped sheet-metal part out of which the contact spring is formed by bending. The sheet-metal part has an approximately rectangular base, which has portions located side by side for the top wall 15, one side wall 17, a bottom wall 11, the further side wall 13, and the contact tab 19. Notches for one support arm 23 are already machined into the portion of the top wall 15, and notches for one support arm 21 are already machined into the bottom wall 11. Two elongated sheet-metal strips, which will form the two spring arms 25, 27, extend from the front portion of the top wall 15 and from the front portion of the bottom wall 11. An impressed feature 41 is already inserted into the side wall 13 and acts as a stop for the upper portion of the box in the bending operation.

In FIG. 5*b*, the two support arms 21, 23 have already been bent upward, as have the two spring arms 25, 27. In FIG. 5*c*, after a further bending step, the two spring arms 25, 27 are orthogonal to the portions for the bottom wall 11 and the top wall 15.

In the next step (see FIG. 5*d*), the spring arm 27 is bent still farther upward, so that it is now bent backward by 180°. The other spring arm 25, conversely, remains in its orthogonal position. In the next step (FIG. 5*e*), the side wall 13 is bent upward together with the box tab 19, and the side wall 17 is bent upward together with the top wall 15. The bottom wall 11, conversely, continues to rest flatly on a support. Shortly before the box-shaped contact part is closed (FIGS. 5*f* and 5*g*), the spring arm 25 is bent backward 180° and then the box-shaped contact part is closed all the way, by the engagement of the box tab 19 with the top of the top wall 15 (FIG. 5*h*).

We claim:

1. A one-piece contact spring, comprising:

a box-shaped contact part having a bottom wall with a given thickness and a top wall, and said box-shaped contact part having an insertion end and an interior;

spring arms respectively formed on said bottom wall and said top wall, said spring arms being bent backward about a bend at the insertion end of said contact part and extending into the interior thereof, said spring arms having free ends with rounded contact points and approaching one another from the insertion end towards said free ends in the interior;

a connection part formed onto said box-shaped contact part opposite the insertion end; and a nipple formed on each of said bottom wall and said top wall, said nipple defining a respective support supporting a respective said spring arm for relieving the bend of said spring arm, said supports being offset from the bend and towards the interior of said contact part by a spacing distance amounting to substantially two to five times the given thickness of the bottom wall.

2. The contact spring according to claim 1, wherein said supports are defined by a kink in each of said spring arms, and each of said spring arms is supported at its kink against said bottom wall or said top wall, respectively.

3. The contact spring according to claim 1, wherein said bottom wall and said top wall have a recess formed therein each defining a respective said support supporting a respective said spring arm.

4. The contact spring according to claim 1, wherein each of said spring arms is thinned at said bend, forming an opening at the bend extending substantially transversely to said spring arm.

5. The contact spring according to claim 1, wherein said contact part has a given width defined by a width of said top wall, and including a box tab extending over an outer surface of said top wall across approximately half the width thereof.

6. The contact spring according to claim 1, including a protrusion formed on said top wall, and wherein said contact part has a side wall extending between said bottom wall and said top wall, said side wall having a recess formed therein on which said protrusion is flatly supported.

7. The contact spring according to claim 1, wherein said contact part has two side walls extending between said bottom wall and said top wall, at least one of said side walls having a slot formed therein pointing into the interior, said slot acting as a stop in a operation of bending a sheet-metal part forming the contact spring.

8. The contact spring according to claim 1, wherein said contact part has two side walls extending between said bottom wall and said top wall, at least one of said side walls being formed with an impression pointing into the interior, said impression acting as a stop in a operation of bending a sheet-metal part forming the contact spring.

9. The contact spring according to claim 1, which further comprises an overlay of gold on said spring arms at said rounded contact points.

10. The contact spring according to claim 1, which further comprises a layer of tin formed on said spring arms at least at said rounded contact points.

11. The contact spring according to claim 1, which further comprises a first support arm stamped out of said bottom wall and a second support arm stamped out of said top wall, said support arms being bent towards a respective said spring arm and supporting said respective spring arm approximately in a middle between the bend and the free end thereof.

12. The contact spring according to claim 11, wherein each of said first and second support arms is chamfered at a free end thereof.

13. The contact spring according to claim 11, which further comprises a reinforcing bead formed on said bottom wall at said first support arm and a reinforcing bead formed on said top wall at said second support arm.

14. The contact spring according to claim 11, wherein each of the spring arms has a length B+C from said support to said rounded contact point, and a ratio B:C being substantially between 2:3 and 3:2; wherein said first and second support arms have a length D approximately 0.8 to 1.2 times B; and wherein said first and second support arms contact said respective spring arm at a boundary between B and C.

* * * * *